United States Patent [19]

Budzich

[11] Patent Number: 4,665,801

[45] Date of Patent: May 19, 1987

[54] COMPENSATED FLUID FLOW CONTROL VALVE

[75] Inventor: Tadeusz Budzich, Moreland Hills, Ohio

[73] Assignee: Caterpillar Inc., Peoria, Ill.

[21] Appl. No.: 887,589

[22] Filed: Jul. 21, 1986

[51] Int. Cl.[4] ..... F15B 13/02

[52] U.S. Cl. ..... 91/420; 91/446; 91/447; 137/596.1; 137/596.13

[58] Field of Search ..... 60/452; 91/420, 446, 91/447; 137/596.1, 596.13

[56] References Cited

U.S. PATENT DOCUMENTS 3,882,896 5/1975 Budzich ..... 137/596.1
4,222,409 9/1980 Budzich ..... 137/596.13
4,487,018 12/1984 Budzich ..... 60/452

*Primary Examiner*—Gerald A. Michalsky

*Attorney, Agent, or Firm*—J. W. Burrows

[57] ABSTRACT

A compensated direction flow control valve arrangement provided with a direction control spool for control of fluid flow to and from a fluid motor, which may be of a cylinder type and is subjected to positive and negative loads. During control of negative load the upstream of the outflow metering orifice, positioned at the outlet of the fluid motor, is maintained at a controlled constant pressure level by a pressure reducing valve handling the fluid flow at negative load pressure. The outflow metering orifice is made independent of the direction control spool and its effective flow area is made responsive and varies with the pressure at the inlet of the fluid motor. The pressure differential across a metering orifice, positioned at the inlet of the fluid motor, is maintained at a constant preselected level by the positive load compensator.

20 Claims, 5 Drawing Figures

COMPENSATED FLUID FLOW CONTROL VALVE

DESCRIPTION

BACKGROUND OF THE INVENTION

This invention relates generally to load responsive fluid control valves and to fluid power systems incorporating such valves, which systems are supplied by a single fixed or variable displacement pump. Such control valves are equipped with an automatic load responsive control and can be used in a multiple load system in which a plurality of loads is individually controlled under positive and negative load conditions by separate control valves.

In more particular aspects this invention relates to direction and flow control valves capable of controlling simulatneously a number of loads, under both positive and negative load conditions.

In still more particular aspects this invention relates to direction and flow control valves, which use a pressure reducing valve in control of negative load.

In still more particular aspects this invention relates to automatic synchronizing controls for synchronization of the compensating and throttling action of positive load compensator and negative load pressure reducing valve, in controlling fluid flow in and out of fluid motors of a cylinder piston rod type.

In still more particular aspects this invention relates to negative load compensating control of a compensated direction control valve, in which the negative load throttling action of negative load pressure reducing valve maintains a constant pressure level upstream of metering orifice positioned at the motor outlet, while the effective flow area of this metering orifice is made responsive to the fluid motor inlet pressure, generated by the pump.

Closed center load responsive fluid control valves, of a fully compensated type, are very desirable for a number of reasons. They permit load control with reduced power loss and therefore increased system efficiency and when controlling one load at a time provide the feature of flow control, irrespective of variation in the magnitude of the load. Such valves are normally provided with positive and negative load compensating controls, which automatically maintain a constant pressure differential and therefore constant flow characteristics, through the metering control orifices handling the flow in and out of the fluid motor. A fluid control valve using a pressure reducing valve to throttle negative load pressure is shown in FIG. 3 of my U.S. Pat. No. 3,882,896, issued May 13, 1975. However, such fully compensated control valves with positive and negative load metering slots located on the direction control spool suffer from one basic disadvantage, when controlling fluid flow to and from an actuator, in the form of a cylinder, which, due to the well known piston rod effect, is characterized by different flow rates between the in and out flows of the cylinder. Depending on the direction of actuation such cylinders, when controlled by the valve of U.S. Pat. No. 3,882,896, can be subjected either to cavitation, or excessive pressures, due to the energy derived from the pump circuit during control of negative load.

This drawback can be overcome in part by the provisions of the fully compensated proportional valves disclosed in my U.S. Pat. No. 4,222,409, issued Sept. 16, 1980. In this compensated control valve, during negative load control, the pump circuit is automatically isolated from the cylinder, preventing generation of excessive pressures, while the cavitation condition is prevented by fluid flow from the pressurized exhaust manifold. This type of control, although very effective, suffers from one serious disadvantage in applications requiring high control stiffness and high frequency response. Those harmful characteristics result from the fact that the energy derived from the pump cannot be directly applied to both ends of the actuator, without going through the stage of isolating the actuator from the pump, during control of negative load. Therefore, such a valve would display some undesirable characteristics, when used as a proportional or servo valve, in servo systems controlling loads.

SUMMARY OF THE INVENTION

It is therefore a principal object of this invention to vary the effective flow area of the metering orifice at the motor outlet, in response to the pressure developed at the metering orifice supplying the cylinder inlet, while the upstream pressure of the metering orifice at the motor outlet is maintained at a constant level by a pressure reducing valve throttling the negative load pressure, to prevent build-up of excessive pressure in the actuator, during control of negative load.

Another object of this invention is to synchronize the flow control action of the positive load compensator and of the pressure reducing valve handling the flow out of the actuator, in control of all types of actuators, by variation in the flow area of the negative load metering slots with the upstream pressure maintained constant, while the pressure differential across the positive load metering slots remains constant at a preselected level.

It is a further object of this invention to provide a flow compensated direction control valve, for control of positive and negative load, which permits the use of positive load compensation and throttling of negative load pressure by the pressure reducing valve in control of cylinder type actuators, while making cavitation within the actuator impossible and automatically guarding against excessive pressure, developed in the actuator, especially during control of negative loads.

It is a further object of this invention to provide a synchronizing control of the action of the positive load compensator and of the pressure reducing valve handling the flow out of the actuator, which automatically compensates for variation between the in and out flows of the actuator, while also compensating for the timing of the direction and flow control metering slots of the direction control spool, during control of both positive and negative loads.

It is a further object of this invention to provide a synchronizing control of the positive load compensator and the negative load pressure reducing valve, which during control of positive load automatically deactivates the negative control circuit, by maintaining the metering orifice at the outlet of the fluid motor in a fully open position, resulting in minimum throttling loss and making interaction between individual positive and negative load controls impossible.

It is a further object of this invention to limit, by the positive load compensator, the cylinder inlet pressure to a certain low pressure level, during control of negative load, to eliminate the possibility of cavitation, ensure high system efficiency and prevent generation of excessive pressures in the cylinder.

It is a further object of this invention to provide a synchronizing control of the positive load compensator and the negative load pressure reducing valve, in which the flow through the positive load metering slots becomes a dominant factor and always takes place at a constant pressure differential, during control of positive and negative load.

It is a still further object of this invention to provide a synchronizing control, which automatically varies the flow area of the metering orifice positioned at the outlet of the fluid motor, during control of negative load, while the pressure upstream of this metering orifice is maintained at a constant level, to maintain the cylinder inlet pressure at a certain minimum relatively constant pressure level.

Briefly the foregoing and other additional objects and advantages of this invention are accomplished by providing a novel load responsive fully compensated fluid control valve, in which, during control of negative load, the pressure at the positive load metering slots, positioned on the direction control spool of the valve, regulates the magnitude of the flow area of independently located motor fluid outflow metering slots, preventing not only an undesirable build-up of the negative load pressure, but also ensuring that the flow to the other end of the cylinder is supplied at a certain minimum positive pressure level, preventing any possibility of cavitation, compensating for different rates of flow in and out of the actuator and timing of the metering slots of the direction control spool, while also ensuring minimum pump loss, during control of negative load.

Additional objects of this invention will become apparent when referring to the preferred embodiments of this invention as shown in the accompanying drawings and described in the following detailed description.

DESCRIPTION OF THE PREFERRED EMBODIMENTS

Figure 1:
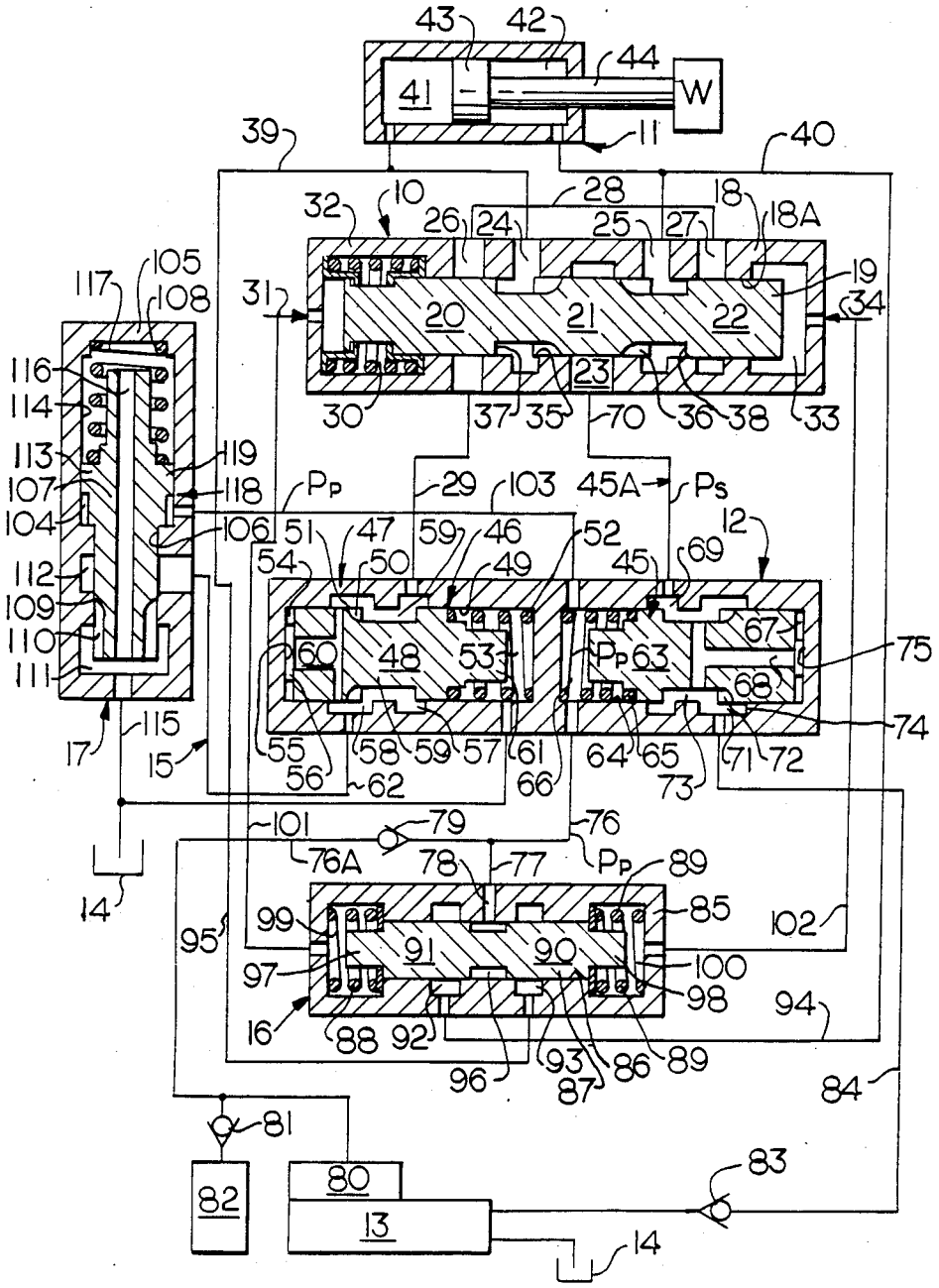
FIG. 1 is a longitudinal sectional view of an embodiment of a single stage compensated direction control valve responding to a hydraulic control signal, together with a sectional view of pressure compensated controls, sectional view of the independent variable motor outflow metering control and a sectional view of load pressure signal identifying and transmitting valve, with schematically shown system pump, actuator in the form of a cylinder and system reservoir, all connected by schematically shown system fluid conducting lines.

Referring now to FIG. 1, an embodiment of a valve assembly including a first valve means, such as, a direction and flow control valve, generally designated as 10 is shown interposed between a fluid motor of a cylinder type, generally designated as 11 and a compensating control assembly, generally designated as 12 supplied with fluid power from a source of pressure, such as, a pump 13 and connected to a reservoir means, such as, a system reservoir 14, which constitutes a part of an exhaust means, generally designated as 15. A logic means, such as, an external logic module, generally designated as 16, is functionally interconnected to the flow control valve 10 and compensating control assembly 12 for identification and transmittal of load pressure signals. A second regulating means, such as, an outlet orifice control, generally designated as 17, is part of the exhaust system 15 and is interposed between the compensating control assembly 12 and the system reservoir 14.

The flow control valve 10 is of a four way type and has a housing 18 provided with a bore 18*a* axially guiding a valve spool means, such as, a valve spool 19. The valve spool 19 provided with lands 20, 21 and 22, which in neutral position of valve spool 19, as shown in FIG. 1, isolate a fluid supply chamber 23, load chambers 24 and 25 and outlet chambers 26 and 27, connected by lines 28 and 29 to compensating control assembly 12 and the exhaust system 15. The land 20 of the valve spool 19 protrudes into a control chamber 30 subjected to pressure of control signal 31 and engages a centering spring assembly 32, well known in the art. The land 22 of the valve spool 19 protrudes into a control chamber 33, which is subjected to pressure of control signal 34. The land 21 of the valve spool 19 is provided with fluid inflow metering orifice means, such as, inflow or positive load pressure metering slots 35 and 36 while lands 20 and 22 are provided with outflow connecting planes 37 and 38.

The load chambers 24 and 25 are connected by lines 39 and 40 with cylindrical spaces 41 and 42 of the fluid motor 11, which are separated by piston 43 connected by a piston rod 44 with load W.

The compensating control assembly 12 is equipped for compensation of both positive and negative loads and is provided with positive load pressure control means, generally designated as 45*a*, and a negative load pressure throttling means, generally designated as 46, which is provided with a pressure reducing valve means generally designated as 47 and also includes the outlet orifice control 17.

The pressure reducing valve 47, operable during control of negative load, is provided with a throttling member means 48 axially slidable in bore 49, provided with throttling port means, such as throttling slots 50 provided with blocking edges 51 and biased by control spring 52, located in a second control chamber 53. One end of the throttling member 48 is subjected to pressure in a third control chamber 54 and in position as shown in FIG. 1 abuts against surface 55 with a stop 56, while an inlet chamber 57 and an exhaust chamber 58 are fully interconnected through annular space 59 defined by bore 49 and stem 59, while the throttling slots 50 remain in a fully open non-throttling position. The exhaust chamber 58 is connected through passage 60 with the third control chamber 54. The throttling member 48 is provided with an extension 61 protruding into the second control chamber 53. The inlet chamber 57 is connected by lines 29 and 28 with the outlet chambers 26 and 27, while the exhaust chamber 58 is connected by line 62 with the outlet orifice control 17 and therefore with the exhaust system 15. The control spring 52 and third control chamber 54 make up first regulating means.

The positive load pressure control means 45*a* includes a positive load pressure compensating control means 45 which is provided with a throttling member 63, guided in a bore 64, biased by control spring 65 and subjected on its cross-sectional area to the pressure Pp in the fourth control chamber 66 and pressure Ps on the fifth control chamber 67. The fifth control chamber 67 is connected by a passage 68 with the second fluid supply chamber 69, which in turn is connected by line 70 with the fluid supply chamber 23. The inlet chamber 71 is functionally interconnected through positive load throttling slots 72 and annular space 73 with the second fluid supply chamber 69. The throttling member 63, control spring 65, and the positive load throttling slots 72 make up a control means. The positive load throttling slots 72 are provided with cut-off edges 74. The end of the throttling member 63, protruding into the fifth control chamber 67, abuts against surface 75 in a non-throttling position as shown in FIG. 1. The fourth control chamber 66 is connected by lines 76 and 77 with a positive load signal port 78 of the external logic module, generally designated as 16. The positive load signal port 78 is also connected through lines 77 and 76 and check valve 79 with an output flow control, such as, the load responsive control 80 of the pump 13 to make up a second transmitting means. The check valve 81, in a well known manner, connects the positive load pressure signals to the load responsive control 80 from schematically shown load sensing system 82. The pump 13 is connected by load check 83 and line 84 to the inlet chamber 71.

The positive load pressure control 45*a* may be of a form in which the pressure from the pump 13, provided with the load responsive control 80, is directly throttled in the inflow metering slots 35 and 36, or may be in the form in which a positive load pressure compensated control, generally designated as 45, is interposed between the pump 13 and the inflow metering slot 35 or 36.

The external logic module 16 has a housing 85, provided with a bore 86, slidably guiding load pressure identifying shuttle means 87, biased by springs 88 and 89, towards neutral position, as shown in FIG. 1, in which lands 90 and 91 isolate chambers 92 and 93. The chamber 92 is connected by line 94 with cylindrical space 42. The chamber 93 is connected by line 95 with the cylindrical space 41. The load pressure identifying shuttle 87 defines annular space 96 and protrudes with its ends 97 and 98 into chambers 99 and 100. The chamber 99 is connected by line 101 with control chamber 30. The chamber 100 is connected by line 102 with control chamber 33. From annular space 96 and positive load signal port 78, the identified positive load pressure signal, at positive load pressure Pp, is transmitted through line 76 to the fourth control chamber 66 and through a line 103 to an annular control chamber 104 of the outlet orifice control 17. The load signal port 78, lines 76 and 103 make up a first transmitting means.

The outlet orifice control 17 comprises a housing 105, provided with a bore 106, slidably guiding a metering member means 107, biased by spring 108 toward position, in which the cut-off edges 109, of outflow metering orifice means, such as, slots 110, isolate an exhaust chamber 111 from an inlet chamber 112, which is connected by line 62 with the exhaust chamber 58. A force generating land 113, of the metering member 107, is slidably guided in a bore 114, which is larger in diameter than bore 106. The exhaust chamber 111, connected by line 115 with the reservoir 14, is also connected by passage 116 with a chamber 117, housing the spring 108.

The deactivating device of the negative load pressure throttling means 46, generally designated as 118, consists of a combination of a force generating annular area 119, which is equal to the difference in area of bores 114 and 106 of the metering member 107, subjected to Pp pressure in the annular control chamber 104, opposing the biasing force of the spring 108. During control of positive load the force generated on annular area 119 fully displaces the metering member 107 upwards, cross-connecting with outflow metering slot 110 the inlet chamber 112 and the exhaust chamber 111, fully deactivating the negative load pressure throttling means 46. The metering member means 107, the spring 108 and the annlular area 119 make up a flow area adjusting means. The annular control area 104, the annular area 119, and the force generating land 113 make up the force generating means.

Figure 2:
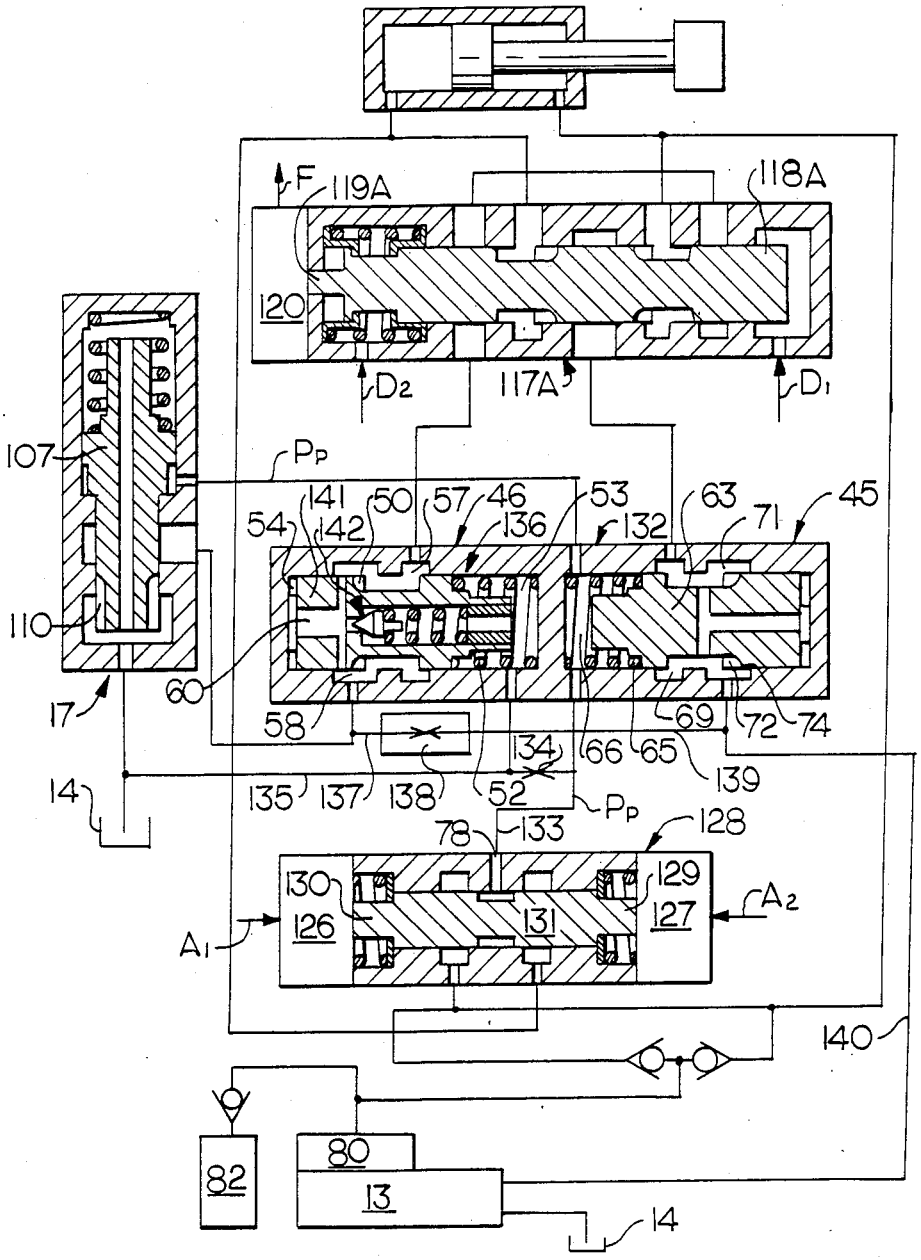
FIG. 2 is a longitudinal sectional view of an embodiment of a single stage compensated direction control valve together with a sectional view of pressure compensated controls, sectional view of motor outlet flow metering control and a sectional view of a load pressure signal identifying and transmitting valve with schematically shown compensator energizing controls, the electro-hydraulic spool actuating controls, system pump, actuator in the form of a cylinder and system reservoir, all connected by schematically shown system fluid conducting lines.

Referring now to FIG. 2 the fluid power and control curcuit of FIG. 2 and its basic control components are very similar to those of FIG. 1 and like components of FIGS. 1 and 2 are designated by like numerals.

The direction and flow control valve, generally designated as 117*a* is very similar to the direction and flow control valve 10 of FIG. 1, with one exception being that the direction control spool 118*a* of FIG. 2 is connected by extension 119*a* to a spool position transducer 120, which generates an electrical position control signal F, proportional to the position of the direction control spool. Control signals A1 and A2 which are generated in response to the positive or negative sign of signal F or by the existance of a pressure signal in $D_1$ or $D_2$ are transmitted to solenoids 126 and 127, mounted on an electrically operated external logic module 128, which through extensions 129 and 130, displaces the load pressure identifying shuttle 131 in the appropriate direction through its entire stroke. The positive or negative sign of the signal F indicates the direction of the displacement of the valve spool 118*a*. A compensating control assembly, generally designated as 132, in its basic principle of operation is identical to that of the compensating control assembly 12 of FIG. 1. Also the outlet orifice controls 17 of FIGS. 1 and 2 are identical in their construction and operation.

The positive load signal port 78, of external logic module 128, is connected by line 133 to compensation energizing means, such as, a leakage control 134, which in turn is connected through line 135 to the system reservoir 14.

The negative load control circuit and specifically the pressure reducing valve 136 is connected through line 137 with another compensation energizing means, such as, an energizing control 138, which in turn is connected by line 139 with the system pump 13.

A throttling member means 141, of the pressure reducing valve 136, is similar in its construction and operation to the throttling member 48 of FIG. 1, the one difference between these two throttling members being a means for controlling the pressure, such as, the pressure relief valve, generally designated as 142, well known in the art, which is located within the throttling member 141 and in a well known manner limits the maximum pressure in the exhaust chamber 58.

Figure 3:
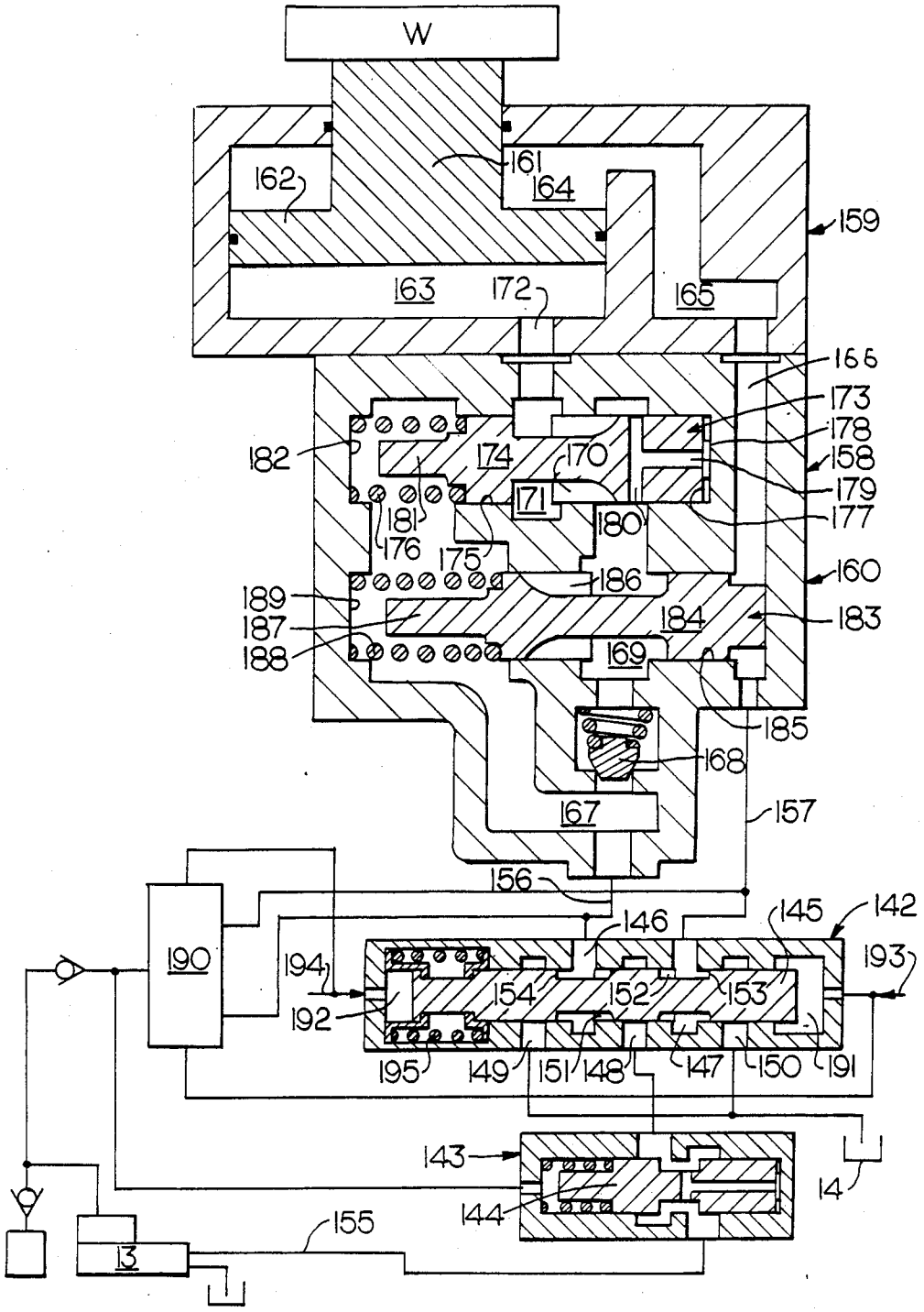
FIG. 3 is a longitudinal sectional view of an embodiment of a single stage compensated direction control valve responding to a hydraulic control signal, together with a sectional view of negative load pressure reducing and flow area changing controls directly mounted on cylinder type actuator and sectional view of a positive load compensator, with schematically shown logic module, system pump and system reservoir, all connected by schematically shown system fluid conducting lines.

Referring now to FIG. 3, the fluid power is supplied to a direction control valve assembly, generally designated as 142, from the pump 13, through a positive load compensating control, generally designated as 143, provided with a throttling member 144. A valve spool 145 of the direction control valve 142, sequentially interconnects load chambers 146 and 147 with a supply chamber 148 and outlet chambers 149 and 150, connected to the reservoir 14. The valve spool 145 is provided with positive load pressure metering slots 151 and 152 and connecting surfaces 153 and 154. The direction control valve assembly 142 is connected by lines 155, 156 and 157 to the system pump 13 and to a mounting means, such as, a fluid motor assembly, generally designated as 158, which consists of fluid motor, generally designated as 159 and a negative load pressure throttling means, generally designated as 160.

A fluid motor assembly 158 is subjected to a unidirectional load W, acting in a downward direction and connected by a piston rod 161 to a piston 162, which divides the cylindrical spaces 163 and 164. The cylindrical space 164 is connected by passages 165 and 166 to line 157. The line 156 is connected through a chamber 167, a check valve 168, a chamber 169, throttling ports 170, a chamber 171 and passage 172 to the cylindrical space 163 of the fluid motor 159. The check valve 168 and the throttling ports 170 make up a fluid bypass means.

The negative load pressure reducing valve, generally designated as 173, is provided with a throttling member 174, slidably guided in bore 175 and biased by a spring 176, towards engagement with surface 177 in control chamber 178, which is connected by passages 179 and 180 with the chamber 169. The throttling member 174, through its extension 181, selectively engages a surface 182.

A fluid flow blocking means, such as, an outlet orifice control, generally designated as 183, is provided with orifice spool 184, slidably guided in bore 185. The orifice spool 184 is provided with metering ports 186 and stop 187 and is biased towards its closed position, as shown, by spring 188. The stop 187 selectively engages surface 189.

The external logic 190 is phased, as set forth in FIG. 1 above, to identify and transmit load pressure signals to the appropriate system controls.

The valve spool 145 of the direction control valve assembly 142 on both ends protrudes into control chambers 191 and 192 subjected to pressure of control signals 193 and 194 generated from a control source, not shown in FIG. 3. The valve spool 145 is centered towards position as shown by a centering spring assembly 195, well known in the art.

Figure 4:
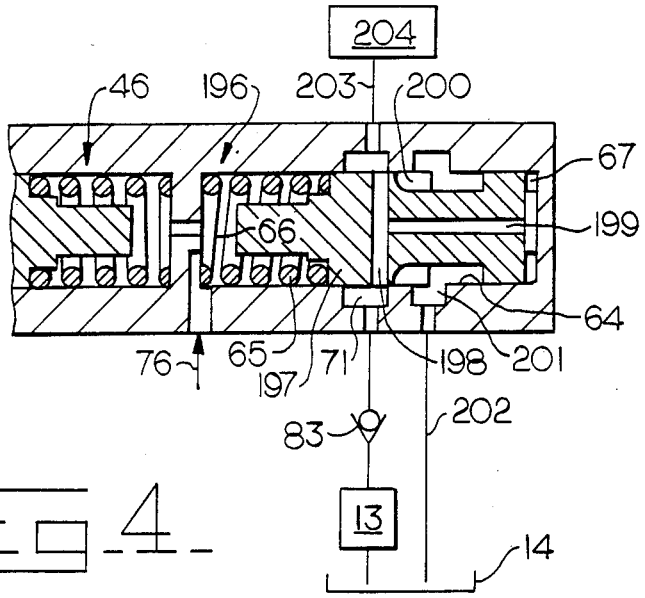
FIG. 4 is a partial sectional view of a positive load compensator of a bypass type with other system components shown schematically.

Referring now to FIG. 4, a positive load pressure compensating control means is shown in a partial section of the compensating control assembly 12 and generally designated as 196, is very similar to the compensated control assembly 12 of FIG. 1 and includes identical negative load pressure throttling means 46 and the pressure reducing valve means 47 (FIG. 1), used in the control of negative load. The pump 13, through the load check 83, is connected to the inlet chamber 71. The throttling member means, such as, the throttling and bypass member 197, guided in bore 64 towards position as shown, is biased by the control spring 65, positioned in the fourth control chamber 66. The inlet chamber 71 is connected by drillings 198 and 199 with the fifth control chamber 67. Throttling and bypass slots 200 are positioned between the inlet chamber 71 and an exhaust chamber 201, which is connected by line 202 to the system reservoir 14. The inlet chamber 71 is connected by line 203 to schematically shown direction control valve assembly 204, which can be identical to the direction and flow control valve 10 of FIG. 1.

Figure 5:
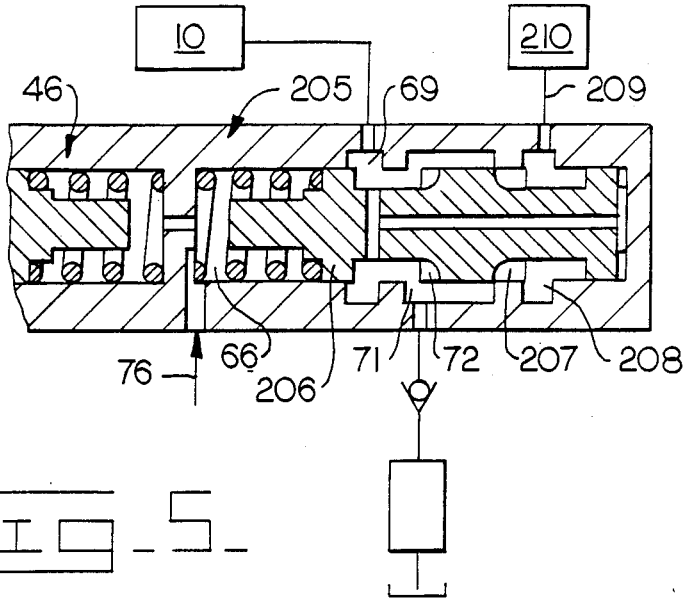
FIG. 5 is a partial sectional view of a positive load compensator of a throttling and bypass type, for use in series type circuits, with series type circuit and other system components shown schematically.

Referring now to FIG. 5, a positive load pressure compensating control means is shown in a partial section of the compensating control assembly 12 and generally designated as 205, is very similar to the compensator control assembly of FIG. 1 and includes the identical negative load pressure throttling means 46 and the pressure reducing valve means 47 (FIG. 1), used in control of negative load. A throttling member means, such as, a throttling and bypass member 206 is provided with positive load throttling slots 72 and bypass slot means, such as, bypass throttling slots 207. The bypass and throttling slots 207 are positioned between the inlet chamber 71 and a bypass chamber 208, which is connected by line 209 to a downstream series power circuit 210, well known in the art.

Referring now back to FIG. 1, the fluid motor 11 is of a cylinder type and is coupled, through the piston rod 44, to the load W, which may be of an opposing or positive, or an aiding or negative type. The fluid flow to and from the fluid motor 11 is controlled by a direction and flow control valve, generally designated as 10, which has its load chambers 24 and 25 connected by lines 39 and 40 to cylindrical spaces 41 and 42 of the fluid motor 11. In a well known manner, the displacement of the valve spool 19, in either direction from its neutral position, as shown in FIG. 1, will connect the load chambers 24 and 25 with either the fluid supply chamber 23, or outlet chambers 26 and 27. The supply chamber 23 is connected by line 70 to the source of pressure fluid, while the outlet chambers 26 and 27 are connected through lines 28 and 29 to the exhaust system.

The valve spool 19 is biased towards its neutral position as shown in FIG. 1, by the centering spring assembly 32, the preload of which determines the pressure level, necessary to displace the valve spool 19 from its neutral position. Any increase in the pressure level, in control chambers 30 and 33 above that, equivalent to the preload of the centering spring assembly 32, will, in a well known manner, displace the valve spool 19 in either direction, the displacement of the valve spool 19 being directly proportional to the pressure of control pressure signal 31 or 34, which is generated by the spool position control system, not shown. During displacement of the valve spool 19, from its neutral position in either direction, the fluid, subjected to the pressure in the supply chamber 23, will be throttled by the inflow or positive load pressure metering slots 35 or 36, on its way to the load chamber 24 or 25 and on the way to the inlet of the fluid motor 11, while the fluid from the outlet of the fluid motor 11 connected with the load chamber 24 or 25, will be throttled, on its way from the outlet chamber 26 or 27 and pressure reducing valve 47 by the outflow or negative load pressure metering slots 110 located in the outlet orifice control 17.

Identification of whether, during the control of load W, the load chamber 24 or 25 is subjected to positive load pressure, is accomplished by external logic module, generally designated as 16. The direction of the load W will determine whether the load chamber 24 or 25 is subjected to load pressure. The desired direction of displacement of the load W, in respect to the direction of its force will establish whether the load W, being controlled at an instant, is of a positive or opposing type. Therefore, for any specific direction of the force, developed by the load W, generation of the control pressure signal 31 or 34 will automatically establish the characteristics of the load. The control pressure signal 31 or 34 is transmitted through lines 101 and 102 to the chamber 99 or 100, causing full displacement, in either direction of the load pressure identifying shuttle 87. The preload of the springs 88 and 89 is so selected that full displacement of the load pressure identifying shuttle 87 will take place before the valve spool 19, biased towards neutral position by the centering spring assembly 32, is displaced, providing the so-called feature of anticipation. The displacement of the load pressure identifying shuttle 87 will connect the chamber 92 or 93 to the positive load signal port 78. Since chambers 92 and 93 are connected by lines 94 and 95 with cylindrical spaces 42 and 41 of the fluid motor 11 the presence of positive load pressure will be identified by the external logic module 16, with positive load pressure Pp, existing in positive load signal port 78, if the load W is of a positive type. Therefore, the positive load pressure identified by the external logic module 16 is transmitted to the compensating control assembly 12.

The positive load pressure signal, during control of positive load, is transmitted from the positive load signal port 78, through lines 76 and 77 to the fourth control chamber 66, of the positive load pressure compensated control, generally designated as 45, which, in a well known manner, will throttle, by positive load throttling slots 72, the fluid flowing from the inlet chamber 71, connected to the pump 13, to the second fluid supply chamber 69, which in turn is connected by line 70 with the fluid supply chamber 23, to maintain a relatively constant pressure differential across the inflow or positive load pressure metering slots 35 or 36. In this way, in a well known manner, through the action of the positive load compensating control 45, with the constant pressure differential automatically maintained between the supply chambers 23 and the load chamber 24 or 25 the flow through the inflow or positive load metering slots 35 or 36 will be directly proportional to the displacement of the valve spool 19 from its neutral position, irrespective of the magnitude of the positive load W.

During control of negative load, in a well known manner, the control of the pressure reducing valve, generally designated as 47, will throttle, by the throttling slots 50, the fluid flow from the inlet chamber 57 to the exhaust chamber 58, to maintain a constant pressure in the exhaust chamber 58 and therefore upstream of outflow metering slots 110. Therefore, the flow of fluid through the outflow or negative load metering slots 110, during control of negative load always takes place at a constant pressure making this flow proportional to the displacement of the metering member 107 from its neutral position, irrespective of the variation in magnitude of the negative load W.

During control of a positive load, the deactivating device 118 automatically deactivates the negative load pressure throttling means 46 in the following manner. The positive load pressure Pp reacts on the annular area 119 of the outlet orifice control 17 generating a force equal to the product of the annular area 119 and Pp pressure, which is opposed by the biasing force of the spring 108. At a specific level of Pp pressure the metering member 107 is moved upwards all the way, providing maximum flow area through the outlfow metering slots 110. During control of the positive load the metering member 107 remains in this position with the negative load pressure throttling means 46 deactivated.

During control of negative load as already described, the flow of fluid from the fluid motor 11 is automatically controlled by the negative load pressure throttling means 46, which consists of the pressure reducing valve 47 and the outlet orifice control 17, in such a way that it is always proportional to the effective flow areas of the outflow or negative load pressure metering slots 110. The outflowing fluid from the fluid motor 11, during control of negative load, from one side of the fluid motor must take place, while the required quantity of fluid is supplied from the pump circuit to the other, or inflow side of the fluid motor 11. In a well known manner, the outflow of the fluid motor of a cylinder type is different from the equivalent required inflow, by the volume caused by the displacement of the piston rod 44. Therefore, for any specific displacement of the valve spool 19, flow at different levels will take place through the inflow or positive load pressure metering slots 35 and 36 and through the outflow or negative load pressure metering slots 110. Since, as described above, the positive load compensating controls and negative load pressure reducing controls of the compensating control assembly 12, automatically maintain either a constant pressure differential across the inflow metering slots 35,36 of the valve spool 19, or maintain a constant pressure upstream of outflow metering slots 110 of the metering member 107, trying to maintain the fluid inflow to the fluid motor 11 equal to the fluid outflow from the fluid motor 11 and since, as already described above, with the fluid motor 11 being of a cylinder type, the inflow and outflow are different, the following parasitic effects will occur during control of negative load.

If the cylindrical space 41 of the fluid motor 11 is subjected to negative load pressure the outflow from the fluid motor 11 will be greater than the equivalent required inflow to cylindrical space 42, and, in a well known manner, the pressure in the cylindrical space 42 will rise to the maximum level, in turn proportionally increasing the negative load pressure Pn in cylindrical space 41, using the energy derived from the pump circuit and will result in not only a very inefficient operation, but in the fluid motor 11 being subjected to excessive pressures.

If the cylindrical space 42, of the fluid motor 11, is subjected to negative load pressure, the outflow from the fluid motor 11 will be smaller than the equivalent inflow and, in a well known manner, the pressure in the cylindrical space 41 will drop below atmospheric and the inlet of the fluid motor 11 will be subjected to cavitation.

The embodiment of the negative load pressure throttling means 46 consists of the pressure reducing valve 47 and the outlet orifice control 17. By subjecting the annular chamber 104 of the outlet orifice control 17 to the positive load pressure Pp the regulating effect is provided in order to synchronize the control action of the negative load pressure throttling means 46, with the control action of the positive load pressure compensated control 45, irrespective of whether the cylindrical space 41 or 42 of the fluid motor 11 is subjected to negative load pressure, the other cylindrical space of the fluid motor 11 cannot be subjected to either excessive positive load pressures or to the cavitation condition.

The synchronizing action between the positive load compensator 45 and the negative load pressure throttling means 46, is accomplished in the following manner. During control of negative load the negative load pressure reducing valve 47, as described above, automatically maintains the constant pressure, equivalent to the preload of the control spring 52, in the exhaust chamber 58 and therefore upstream of the outflow or negative load pressure metering slots 110. The biasing force, transmitted to the throttling member 48 by the control spring 52, automatically determines the level of the controlled pressure of the negative load pressure reducing valve 47. The annular control chamber 104 is subjected to Pp pressure, transmitted from fourth control chamber 66 through line 103. Since the exhaust chamber 111 and chamber 117, housing the spring 108, are subjected to reservoir pressure, the Pp pressure in the annular control chamber 104 will develop a force, acting in an upward direction and opposing the biasing force of the spring 108, this force being equal to the product of the annular area 119 and the Pp pressure. This force, in a well known manner, will position the metering member 107, in respect to the housing 105, against the biasing force of the spring 108, the position of the metering member 107, with its outflow metering slots 110, becoming a function of Pp or cylinder inlet pressure. In this way the effective flow area through the outflow metering slots 110 becomes a function of Pp pressure and proportionally increases with the increase in Pp pressure, above a certain Pp pressure level, equivalent to the preload in the spring 108. In this way the flow through the outflow, or negative load pressure metering slots 110 becomes a function of the inlet pressure of the fluid motor 11, this inlet pressure automatically seeking an equilibrium condition, at which the quantity of fluid, supplied to the fluid motor 11 through the inflow or positive load pressure metering slots 35 or 36, at a constant pressure differential controlled by the positive load compensating control 45 and equivalent to preload of the control spring 65, will produce an equivalent flow out of the fluid motor 11, through the outflow or negative load pressure metering slots 110, at an increased effective flow area of those metering slots. This synchronizing and flow equilibrium seeking action, between the compensating controls of the positive load compensator 45 and the negative load pressure throttling means 46, is made possible by maintaining the constant level of the pressure, controlled by the negative load pressure reducing valve 47, upstream of the outflow metering slots 110, while the effective area of the outflow metering slots 110 is made responsive to the actuator inlet pressure, so that this effective flow area can be varied in response to the increase in the inlet pressure of the fluid motor 11, while it is automatically maintained constant, at each specific level, as determined by the actuator's inlet pressure. Therefore, through adjustment in the flow area of the outflow metering slots 110, in response to the actuator inlet pressure, not only the automatic equilibrium condition between the inlet and outlet actuator flow is established, which automatically compensates for the difference between inlet and outlet actuator flows, as developed in the actuator in the form of a cylinder, but also the variation, due to manufacturing tolerances in the flow areas of the positive load metering slots 35 and 36, is automatically compensated for, while also eliminating all of the parasitic effects, due to variation in timing of the valve spool 19.

The valve spool 19 of the direction and flow control valve 10 is only provided with positive load pressure inflow metering slots 35 and 36, while the outflow metering slots are provided on metering member 107, of the outlet orifice control 17. Therefore, the valve spool 19 is provided on lands 22 and 20 with connecting planes 37 and 38, which with minimum displacement of the valve spool 19, from its neutral position, interconnect one of the load chambers 24 or 25 with one of the outlet chambers 26 or 27, without any significant throttling action taking place between those chambers, during control of negative load. This feature permits very accurate synchronization between the control action of the positive and negative load controls, since, the only metering action takes place at the outflow metering slots 110. This specific feature also permits synchronization of positive and negative load control during control of negative load at minimum inlet pressure of the fluid motor, thus increasing the efficiency of the system.

The flow areas of the inflow or positive load pressure metering slots 35 or 36 are so established, that they can supply enough fluid flow into the fluid motor 11, at the constant pressure differential, controlled by the positive load compensator 45, so that the cavitation condition, in cylindrical spaces 41 and 42, can never take place. Then the equivalent outlet flows from the fluid motor 11 are automatically controlled by variation in the effective flow area of the outflow or negative load pressure metering slots 110, in response to the pressure at the actuator inlet, so that the actuator inlet pressure, during control of negative load, cannot exceed a certain maximum predetermined value, which is independent of the magnitude of the negative load being controlled. As a result of this specific control feature, induced by the action of the outlet orifice control 17, the controlled flow through the inflow or positive load pressure metering slots 35 or 36, by the positive load compensating control 45, becomes a dominant factor and automatically establishes and controls the velocity of the negative load W.

In FIG. 1 the annular control chamber 104 of the outlet orifice control 17 is connected with fourth control chamber 66 by line 103 and therefore is subjected to the positive load pressure Pp, which is the pressure downstream of the inflow or positive load pressure metering slots 35 or 36 and therefore is the pressure of the inflowing fluid to the fluid motor 11. Since the positive load pressure compensated control 45 maintains a constant pressure differential between the pressure in the fluid supply chamber 23 and Pp pressure, the pressure in the fluid supply chamber 23, which is Ps pressure, is always directly related to Pp pressure and could be used as a control input to the outlet orifice control 17. In such a case the annular control chamber 104 would be directly connected to the fluid supply chamber 23. If the capability of transmittal of high energy control signals through the external logic module 16 is limited, direct connection between the fluid supply chamber 23 and the annular control chamber 104 might be preferable.

Referring now back to FIG. 2 the fluid power and control circuit of FIG. 2 and its basic control components are very similar to those of FIG. 1.

The direction and flow control valve, generally designated as 10, the outlet orifice control, generally designated as 17, and the external logic module, generally designated as 16, of FIGS. 1 and 2 are identical. The compensating control assembly of FIG. 2, generally designated as 132, is very similar to the compensating control assembly of FIG. 1 and together with the outlet control 17 performs an identical function, in synchronizing the control action of the positive and negative load controls. The positive load pressure compensated controls 45 of FIGS. 1 and 2 are identical. The pressure reducing valve 136 of FIG. 2 is very similar to the pressure reducing valve 47 of FIG. 1. The throttling member 141 of the pressure reducing valve 136 is of a similar configuration as that of throttling member 48, the one difference between those two throttling members being the presence of the pressure relief valve, generally designated as 142, which is positioned within the throttling member 141. The significance and operation of this relief valve will be described later in the text.

The direction and flow control valve, generally designated as 117*a* is very similar to the direction and flow control valve 10 of FIG. 1 and meters, in an identical way, through identical metering slots, the fluid flow between identical valve chambers. However, in FIG. 2 the spool 118*a* of the direction and flow control valve 117*a* is connected by extension 119*a* to the spool position transducer 120, well known in the art, which generates an electrical signal F, proportional to the position of the direction control spool 118*a*, which position is determined by the magnitude of the control pressure signals D1 and D2. The control signal A1 as generated by the control signal F is transmitted to the solenoid 126, which is connected by the extension 130 to the load pressure identifying shuttle 131. The control signal A2 is transmitted to the solenoid 127, which is connected by the extension 129 to the load pressure identifying shuttle 131. In this way, in a manner similar to that as described when referring to FIG. 1, the electrically operated external logic module 128 identifies the presence of positive load pressure and transmits the positive load pressure signal to the positive load compensating control 45 and to the outlet orifice control 17.

Especially in servo systems, when positioning a tool, very small corrections in the tool position may be required, those small corrections requiring small displacements of the spool 118*a* of the direction and flow control valve 117*a*. Under those conditions it is preferable to maintain the positive load compensating control 45 and the negative load pressure throttling means 46 in positions regulating minimum flows and therefore with positive throttling slots 72 and negative load throttling slots 50 partially or fully closed. With the valve spool 118*a* of the direction and flow control valve 117*a* in neutral position, no load pressure signals are transmitted from the external logic module 128 and the throttling members 63 and 141 of the controls 45 and 136, subjected to the biasing forces of the springs 65 and 52, move into their fully open minimum throttling position.

With the direction and flow control valve 118*a* in its neutral position and the load pressure identifying shuttle 131 centrally located, as shown in FIG. 2, the fourth control chamber 66 becomes isolated. The leakage control 134 is provided and it interconnects, for small fluid flows, the fourth control chamber 66 with the reservoir 14, through line 135. The leakage control 134 can be of a simple orifice type, the flow through which will vary with the positive load pressure Pp, or can be of a compensated flow control type, well known in the art, which will provide a constant leakage from the fourth control chamber 66, irrespective of the magnitude of the load pressure Pp. The leakage control 134 automatically ensures that, in standby conditions, the pressure in the fourth control chamber 66 will be the same as reservoir pressure and the throttling member 63 will be fully displaced to the left, from the position as shown in FIG. 2, isolating, with its cut-off edges 74, the inlet chamber 71 from the second fluid supply chamber 69. In this standby position the throttling member 63, with minimal displacement, is capable of throttling fluid flows at very small flow levels, increasing the frequency response of the control, for small corrections in position of the load W. With the load sensing circuit activated, the flow transmitting capacity of the positive load pressure signals, through the external logic module 128, is so large that the leakage flow, through the leakage control 134, becomes insignificant.

Similarly, with the direction and flow control valve 117*a* in neutral position and the load pressure identifying shuttle 131 centrally located, the third control chamber 54 becomes isolated by the metering member 107 and the throttling member 141, under biasing force of the spring 52, will drift towards fully open position, as shown in FIG. 2. Although the negative load pressure is isolated from the exhaust chamber 58, it is still connected through line 137 with the energizing control 138 connected to a source of pressure. The energizing control 138 may be of identical construction as that of leakage control 134 and transmits fluid flow, at a very small level, to the negative load circuit. With the pressure from the source of pressure being high enough to compress the spring 52 in standby position, the throttling member 141 is maintained in a closed position, with its blocking edges isolating the inlet chamber 57 from the exhaust chamber 58. If the source of pressure is connected to the pump 13, the negative load pressure in the exhaust chamber 58 must increase to a level to compress the spring 52 and energize the throttling member 141, but it should not be permitted to substantially exceed the control pressure level of the pressure reducing valve 136. This is accomplished, in a well known manner, by the relief valve 142. With the load sensing circuit activated, the flow transmitting capacity of the negative load pressure is so large, that the flow through the energizing control 138 becomes insignificant and does not affect the operation of the controls. Therefore the energizing control 138 ensures that in standby position the throttling member 141, with minimal displacement, is capable of throttling fluid flows at very small flow levels, increasing the frequency response of the control, for small corrections in position of the load W. In the arrangement of FIG. 2, the energizing control 138 is directly connected by line 139 to line 140 and therefore is directly connected to the discharge of the system pump.

Referring now back to FIG. 3, the negative load pressure control, generally designated as 160, is directly mounted on fluid motor 159 and is a part of the fluid motor assembly, generally designated as 158. The fluid flow to and from the fluid motor 159, which is in the form of a cylinder, is controlled by the direction control valve assembly, generally designated as 142, which is supplied with fluid under pressure from the pump 13, through the positive load pressure compensated control, generally designated as 143, provided with the throttling member 144, of a type well known in the art. The external logic 190 is phased, as set forth in FIG. 1 above, into the control circuit, to identify and transmit the load pressure signals to the appropriate system controls.

In their basic principle of operation the controls of FIGS. 1 and 3 are very similar, the basic differences between those controls being as follows.

In FIG. 1 the negative load controls are intended for control of bidirectional negative load and are located together and away from the fluid motor 11.

In FIG. 3 the negative load control is directly mounted on the fluid motor and basically is intended for control of a unidirectional negative load. Because of its location this negative load control can perform the additional function of blocking the flow at negative load pressure, during rupture of the line 156 connecting the fluid motor and the direction control valve assembly.

The basic control components of FIGS. 1 and 3 which are identical in their principle of operation are as follows. The basic construction of the negative load pressure reducing valve, generally designated as 173, together with the throttling member 174 and the spring 176 is the same as that of the negative load pressure reducing valve 47 of FIG. 1, provided with throttling member 48 and the spring 52. The operation of the above controls of FIGS. 1 and 3 is identical. The basic construction and operation of the direction control valve assembly 142 of FIG. 3 is identical to that of directional control valve assembly 10 of FIG. 1. The external logic module 16 of FIG. 1 can be identical to the external logic 190 of FIG. 3. The positive load compensator 143 with its throttling member 144 of FIG. 3 is identical in its construction and operation to the positive load compensator 45 of FIG. 1. The outlet orifice control, generally designated as 183 in FIG. 3, is very similar in construction and identical in its principle of operation to the outlet orifice control 17 of FIG. 1.

The control circuit of FIG. 3 is basically intended for control of a unidirectional load W, which acts in a downward direction. Therefore, in the fluid motor 159 the negative load is only controlled from the cylindrical space 163.

During raising of the load W, the valve spool 145 is moved from left to right, metering the fluid flow at positive load pressure from the supply chamber 148 to the load chamber 146 through the positive load pressure metering slots 151, while the load chamber 147 is directly connected, without throttling by the connecting surface 153 to the outlet chamber 150. Since the positive load compensator 143, in a well known manner, controls a constant pressure differential across the positive load metering orifice 151, a flow proportional to the displacement of the valve spool 145 and independent of the magnitude of the load W is supplied from load chamber 146, through line 156, chamber 167, check valve 168, chamber 169, throttling ports 170, chamber 171 and passage 172 to the cylindrical space 163, of the fluid motor 159. The fluid displaced from the cylindrical space 164 is transmitted through passages 165 and 166, line 157, load chamber 147 and outlet chamber 150 to the system reservoir 14. The orifice spool 184, during raising of the load W, remains in the position as shown in FIG. 3, since it is subjected to high positive load pressure in the chamber 167 and to biasing force of spring 188, while the otner end of the orifice spool 184 is subjected to reservoir pressure in the passage 166. The throttling member 174, of the pressure reducing valve 173, is subjected on both ends, in control chamber 178 and in chamber 167, to positive load pressure and therefore pressurewise is in a force balance position, while being biased towards position as shown in FIG. 3, by a spring 176.

Assume that during raising of the load W that the line 156 will rupture. The pressure in the chamber 167 will drop to atmospheric pressure and the check valve 168 will seat. The throttling member 174 will move all the way from right to left, with its extension 181 engaging surface 182 and throttling ports 170 isolating the chambers 171 and 169. The orifice spool 184 will stay in the position as shown in FIG. 1, due to the biasing force of spring 188, since the chamber 167 and passage 166 are now subjected to atmospheric pressure. Therefore, under those conditions the cylindrical space 163 and chambers 171 and 169 are fully isolated from chamber 167 and broken line 156 with load W prevented from further movement.

During control of negative load, while the load W is being lowered, the valve spool 145 is moved from right to left, connecting the supply chamber 148, through positive load metering slot 152, line 157 and passages 166 and 165, with cylindrical space 164. At the same time cylindrical space 163 is connected through passage 172, the chamber 171, throttling ports 170 to chamber 169, while the chamber 167 is connected through line 156, the load chamber 146 and displaced connecting surface 154 to outlet chamber 149 and therefore to the system reservoir 14. Under those conditions the throttling member 174, of the pressure reducing valve 173, will assume, in a manner as previously described, a modulating throttling position, in which it maintains the chamber 169 at a constant pressure level, equivalent to the preload in the spring 176, this pressure level being independent of the magnitude of the load W. Due to the action of the positive load compensator 143, maintaining a constant pressure differential across the positive load metering orifice 152, the pressure in the passage 166 will continue to rise. The pressure in the passage 166, reacting on the cross-sectional area of the orifice spool 184 will move it against the biasing force of spring 188 from right to left, opening through metering ports 186 a passage between the chambers 169 and 167. Since, as described above, the pressure in the chamber 169 is maintained at a constant level by the pressure reducing valve 173, the flow from the chamber 169 to the chamber 167 will be proportional to the displacement of the orifice spool 184 and therefore to the pressure in passage 166, controlled by the positive load compensating circuit. In this way, in a manner as described when referring to FIG. 1, during control of negative load the control action of the positive load compensator and the negative load pressure reducing valve will be completely synchronized, maintaining the cylindrical space 164 at a minimum pressure level preventing cavitation, while also preventing the build-up of excessive negative load pressure in cylindrical space 163.

Upon rupture of the line 156, when controlling a negative load, in a well known manner, the pressure in the passage 166 will drop and the orifice spool 184, biased by spring 188, will move to the position as shown in FIG. 3, isolating chamber 169 from chamber 167 and automatically stopping the load. With the line 156 broken, the load W still can be lowered in a controlled way by regulating the pressure in passage 166, through the combined action of the positive load pressure metering slot 152 and positive load compensator 143.

Referring now back to FIG. 4, the throttling and bypass member of the compensating control 196, in a well known manner, maintains a constant pressure differential between the pressure in the inlet chamber 71 and the fourth control chamber 66, which is connected through line 76, with the positive load identifying circuit of the external logic module 16 of FIG. 1, or of the other figures. The level of this constant pressure differential is dictated by the preload in the control spring 65 and is controlled by the throttling action of the throttling and bypass slots 200, diverting the flow from the pump 13, which may be of a constant displacement type, to the exhaust chamber 201 and therefore to the system reservoir 14.

Referring now back to FIG. 5, the throttling and bypass member 206 of the compensating control 205, in a well known manner, maintains a constant pressure differential between the second fluid supply chamber 69 and the fourth control chamber 66, which is supplied with fluid at positive load pressure through line 76 from the external logic module 16 of FIG. 1, or of the other figures. The control of the pressure differential is obtained either through the throttling action of the positive load throttling slots 72, or through the bypass action of bypass and throttling slots 207. The bypass and throttling action of the bypass and throttling slots 207 permit the excess flow from the pump 13 to be passed to the bypass chamber 208, which is connected in series by line 209 with the series circuit 210. With the positive load control of FIG. 5 the direction and flow control valve 10, connected to the second flow control chamber 69, has an automatic flow priority over the control valves of series circuit 210, since only the excess flow, over that required by the direction and flow control valve 10, can be passed to the series circuit 210.

The positive load controls of FIGS. 4 and 5 are integrated in an identical way with the negative load compensating controls and regulating controls of FIGS. 1 and 2 and result in identical control characteristics of the control systems of FIGS. 1 and 2, since, through different actions, they still maintain the constant pressure differential, between the positive load pressure and the pressure upstream of the positive load pressure metering slots.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

I claim:

1. A valve assembly operable to control positive and negative loads and subjected to positive and negative load pressure interposed between a fluid motor, reservoir means and a source of pressure connected to a pump, first valve means operable to selectively interconnect said fluid motor with said reservoir means and said source of pressure, positive load pressure control means between said fluid motor and said pump, negative load pressure throttling means between said fluid motor and said reservoir means said negative load pressure throttling means including pressure reducing valve means having a throttling member means and fluid outflow metering orifice means, first regulating means of the throttling action of said throttling member means in said pressure reducing valve means operable to control the flow of fluid through any specific flow area of said fluid outflow metering orifice means at a relatively constant control pressure upstream of said fluid outflow metering orifice means independent of the magnitude of said negative load pressure, and second regulating means in said negative load pressure throttling means having flow area adjusting means operable to increase flow area of said fluid outflow metering orifice means with the increase in said positive load pressure whereby fluid flow through said fluid outflow metering orifice means becomes independent of the magnitude of said negative load pressure and can be increased with the increase in said positive load pressure during control of negative load.

2. A valve assembly as set forth in claim 1 wherein said first regulting means has throttling port means positioned upstream of said fluid outflow metering orifice means.

3. A valve assembly as set forth in claim 1 wherein said positive load pressure control means includes fluid inflow metering orifice means.

4. A valve assembly as set forth in claim 1 wherein said positive load pressure control means includes fluid inflow metering orifice means and positive load pressure compensating control means upstream of said fluid inflow metering orifice means said compensating control means having control means operable to control the pressure differential across said fluid inflow metering orifice means at a relatively constant preselected level.

5. A valve assembly as set forth in claim 4 wherein said compensating control means includes compensation energizing means whereby said compensating control means is maintained in minimum flow throttling position in anticipation of positive load compensating action.

6. A valve assembly as set forth in claim 1 wherein logic means has shuttle means operable to identify the presence of said positive load pressure and first transmitting means operable to transmit control signal of said identified positive load pressure to said positive load pressure compensating control means and to said second regulating means of said negative load pressure throttling means.

7. A valve assembly as set forth in claim 6 wherein said pump has an output flow control responsive to said positive load pressure and said logic means has second transmitting means operable to transmit control signal of said identified positive load pressure to said output flow control of said pump.

8. A valve assembly as set forth in claim 1 wherein said second regulating means has force generating means responsive to pressure at said fluid inflow metering orifice means.

9. A valve assembly as set forth in claim 1 wherein said second regulating means has deactivating means of the throttling action of said outflow metering orifice means when pressure at said fluid inflow metering orifice means reaches a certain determined level.

10. A valve assembly as set forth in claim 1 wherein said negative load pressure throttling means includes compensation energizing means whereby said negative load pressure throttling member means is maintained in minimum flow throttling position in anticipation of negative load compensating action.

11. A valve assembly as set forth in claim 1 wherein said negative load pressure throttling means includes pressure reducing valve means and compensation energizing means and means to limit pressure from said energizing means whereby said pressure reducing valve means is maintained in minimum flow throttling position in anticipation of negative load compensation action.

12. A valve assembly as set forth in claim 1 wherein the first regulating means operable to control pressure upstream of said fluid outflow metering orifice means includes compensation energizing means whereby said first regulating means operable to control pressure upstream of said fluid outflow metering orifice means is maintained in minimum flow throttling position in anticipation of throttling of negative load pressure.

13. A valve assembly as set forth in claim 1 wherein said negative load pressure throttling means has mounting means on said fluid motor.

14. A valve assembly as set forth in claim 1 wherein said negative load pressure throttling means includes a fluid bypass means operable to supply fluid flow from said source of pressure to said fluid motor through said negative load pressure throttling means.

15. A valve assembly as set forth in claim 1 wherein said negative load pressure throttling means has fluid flow blocking means operable to prevent fluid flow from said fluid motor to said reservoir means when said positive load pressure drops below a certain predetermined level.

16. A valve assembly as set forth in claim 1 wherein said positive load pressure control means includes fluid inflow metering orifice means, and positive load pressure compensating control means upstream of said inflow metering orifice means said compensating control means having throttling member means operable to control bypass flow between said pump and said reservoir means to control the pressure differential across said inflow metering orifice means at a relatively constant preselected level.

17. A valve assembly as set forth in claim 1 wherein said positive load pressure control means includes fluid inflow metering orifice means, and positive load pressure compensating control means upstream of said fluid inflow metering orifice means said compensating control means having fluid throttling member means between said pump and said fluid motor and bypass slot means between said fluid pump and a series power circuit said positive load pressure compensating control means operable to control the pressure differential across said fluid inflow metering orifice means at a relatively constant preselected level.

18. A valve assembly operable to control positive and negative loads and subjected to positive and negative load pressure interposed between a fluid motor, reservoir means and a source of pressure connected to a pump, first valve means operable to selectively interconnect said fluid motor with said reservoir means and said source of pressure, fluid inflow metering orifice means interposed between said fluid motor and said pump, compensating control means upstream of said fluid inflow metering orifice means operable to maintain by fluid throttling a relatively constant pressure differential across said fluid inflow metering orifice means, negative load pressure throttling means between said fluid motor and said reservoir means said negative load pressure throttling means including pressure reducing valve means having a throttling member means and fluid outflow metering orifice means, first regulating means of the throttling action of said throttling member means in said pressure reducing valve means operable to control the flow of fluid through any specific flow area of said fluid outflow metering orifice means at a relatively constant control pressure at said fluid outflow metering orifice means independent of the magnitude of said negative load pressure, and second regulating means in said negative load pressure throttling means having flow area adjusting means operable to increase flow area of said fluid outflow metering orifice means with the increase in pressure at said fluid inflow metering orifice means whereby during control of negative load a relatively constant pressure differential is maintained across said fluid inflow metering orifice means while the pressure level at said fluid inflow metering orifice means is limited to a certain predetermined level.

19. A load responsive valve assembly comprising a compensating control assembly and a first valve means having first and second load chambers connected to a fluid motor operable to control positive and negative loads and subjected to positive and negative load pressure, an inlet chamber of the compensating control assembly connected to a fluid pump, outlet chambers operably connected to reservoir means, and a supply chamber, valve spool means operable to sequentially interconnect said load chambers with said supply chamber and said outlet chambers, inflow variable orifice means on said valve spool means operable to meter fluid flow between said supply chamber and said load chambers, compensating control means interposed between said inlet chamber and said supply chamber operable to maintain a relatively constant pressure differential across said inflow variable metering orifice means during control of said positive and said negative load, logic means operable to identify the presence of positive load pressure in said load chambers and to transmit a positive load pressure signal to said compensating control means, constant pressure reducing valve means operable to throttle said negative load pressure from said outlet chambers to a relatively constant predetermined pressure level, outflow metering orifice means interposed between said constant pressure reducing valve means and said reservoir means, and flow area adjusting means of said outflow variable orifice means having force generating means responsive to pressure downstream of said inflow variable orifice means.

20. A valve assembly as set forth in claim 19 wherein said flow area adjusting means of said outflow variable orifice means has metering member means whereby flow area of said outflow variable orifice means can be varied in a way independent of the variation in flow area of said inflow variable orifice means.

* * * * *